US005505152A

United States Patent [19]

Huber

[11] Patent Number: 5,505,152

[45] Date of Patent: Apr. 9, 1996

[54] LATERAL ADJUSTING WINDSURFING HARNESS LINES

[76] Inventor: John L. Huber, BMI Industries, P.O. Box 549, Avila, Calif. 93424

[21] Appl. No.: 443,714

[22] Filed: May 18, 1995

[51] Int. Cl.[6] ..... B63H 9/10

[52] U.S. Cl. ..... 114/39.2

[58] Field of Search ..... 114/39.2; 441/69; 482/24

[56] References Cited

U.S. PATENT DOCUMENTS 4,516,295 5/1985 McCoy ..... 114/39.2

5,134,952 8/1992 Doolittle ..... 114/39.2

5,215,023 6/1993 Johnson ..... 114/39.2

*Primary Examiner*—Jesus D. Sotelo

[57] ABSTRACT

A new windsurfing harness line unit is disclosed. Previous harness lines have two open and independent ends whereas the present disclosure provides a hollow braided tube or rope that is connected to these ends, holding them as one unit firmly to the boom of the windsurfing rig. While under sail the unit can be adjusted either for or aft along the boom by grasping either of the said ends with one hand and pushing in the desired direction, thereby repositioning the unit to a more desired or balanced position.

2 Claims, 1 Drawing Sheet

LATERAL ADJUSTING WINDSURFING HARNESS LINES

BACKGROUND OF THE INVENTION

The prior art, as exemplified by U.S. Pat. Nos. 5,134,951; 5,215,023 and 4,516,295 is generally illustrative of the pertinent art, but the aforementioned patents are non-applicable to the present invention. While the prior art expedients are generally acceptable for their intended purposes only, they have not proven entirely satisfactory in that they are either complex and expensive to manufacture, or to use, or to operate. As a result of the shortcomings of the prior art, typified by the above, there has developed a substantial need for improvement in this field.

The principal object of this invention is to provide a device or article of this character which combines simplicity, strength and durability in a high degree together with inexpensiveness of constriction so as to encourage widespread use thereof.

The invention accordingly consists in the features of construction, and the combination and arrangement of elements and parts which will be exemplified in the construction hereinafter described, and of which the scope of application will be indicated in the following claims.

BRIEF SUMMARY OF THE INVENTION

A watercraft commonly referred to as a windsurfer consists of the following parts: A lightweight floatable hull or "board" on which the operator stands; straps attached to the board to hold the operator's feet securely to the board; a fin under the board allowing it to track through the water; a mast attached to the board by means of a universal joint; a sail attached to the mast and booms extending from the mast on both starboard and port (i.e. right and left) sides of the sail. To each boom is attached what is generally referred to as a harness line. Each of these are attached at two locations far enough apart to allow the line to hang down from the boom in a wide loop. This allows the operator to attach his upper body by means of an open hook that is strapped to his upper body, to the hanging loop.

This invention resides in that part of the sailboard unit referred to as the harness lines specifically in how the harness lines are secured to the booms as well as the means of adjusting said harness lines laterally on the booms, an adjustment that is critically important to the system-operator balance and operation. The present invention does not apply to adjustment of the length of the loop, a feature which tends to be less important with the advance of the total unit design. In fact, major manufacturers of harness lines offer fixed lengths because many sailors find that particular adjustment an unnecessary addition of equipment in a sport already incumbered with paraphernalia.

Lateral adjustment on the other hand, is very important. It is also important that the harness lines, once adjusted, retain their position. The currently availably harness lines must be separately adjusted both for and aft, are extremely difficult to adjust while under sail and tend to migrate out of adjustment. On the other hand, the present invention requires only a slight push on either the for end of the unit in order to adjust the entire unit aft, or a slight push on the aft end to adjust it forward. It locks in place, will not migrate and it is the most simple and least expensive device to manufacture relative to prior art and currently marketed harness lines.

BRIEF DESCRIPTION OF THE DRAWINGS

The invention will be better understood and objects other than those those forth above will become apparent when consideration is given to the following detailed description thereof. Such description makes reference to the annexed drawings, wherein.

DESCRIPTION OF THE EMBODIMENT

Figure 1:
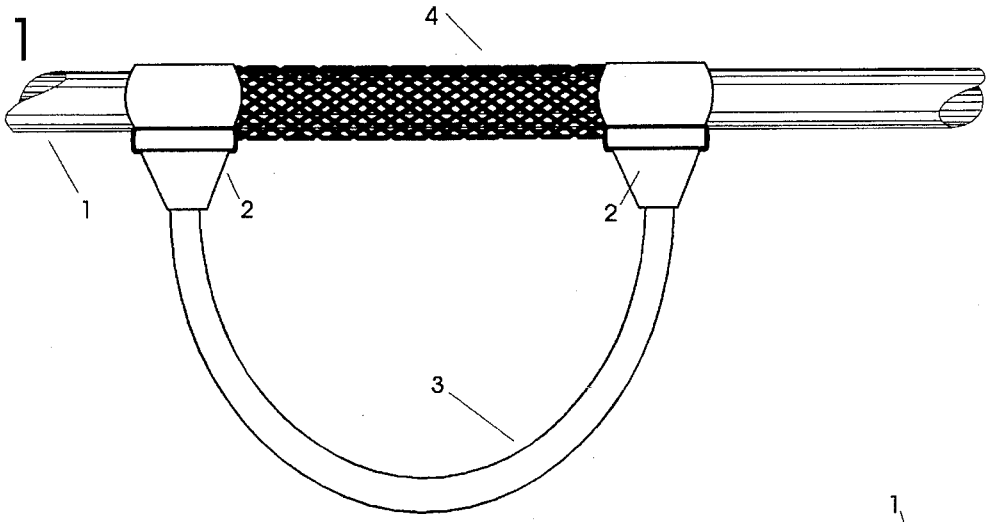
FIG. 1 is a front view of a windsurfing boom showing the present invention attached to it.

With reference to the drawings there is shown and illustrated in FIG. 1, a unit of windsurfing harness lines incorporating the present invention. This embodiment as shown is constructed in accordance with the principles of the invention and designated generally by the reference character 4. The illustrated embodiment of the invention includes a braided tube 4. The braided tube 4 is shown connected to the cinched end 2 of windsurfing harness line 3. The cinched end 2 are cinched to a windsurfing boom 1. In its resting position the braided tube 4 will not migrate in either direction along the boom 1, as the braided tube 4 must be manufactured with a slightly smaller inside diameter than the outside diameter of the boom 1.

Figure 2:
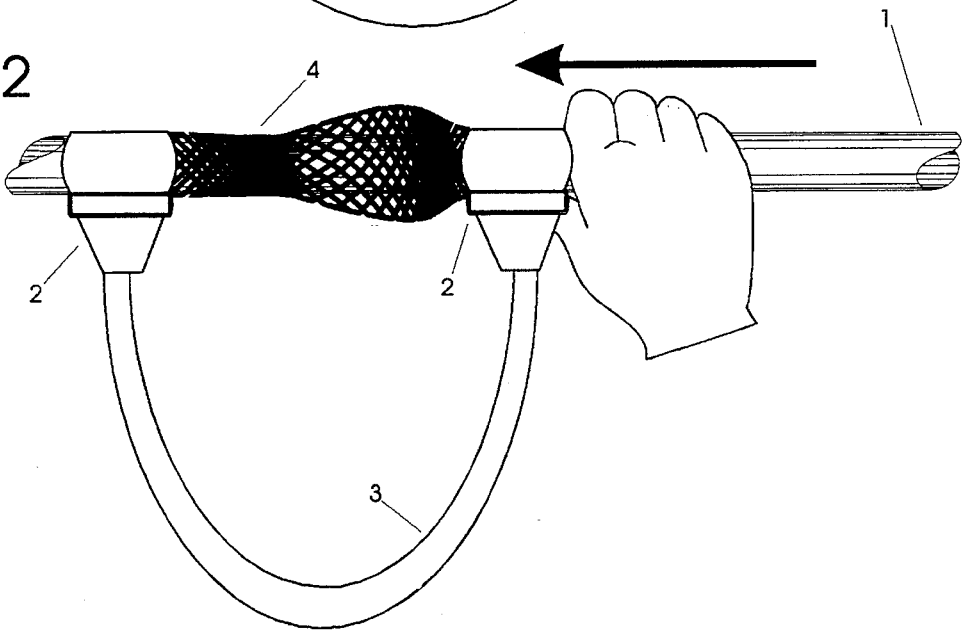
FIG. 2 is another front view of the invention illustrating the simplicity of lateral movement along the boom by use thereof.

FIG. 2 shows the method for adjusting the position of the harness lines laterally along the boom 1. During operation the hands are generally positioned just outside both cinched ends 2 of the harness lines. When the operator feels he has more wind force either for or aft of the center of the loop 3 of his harness lines, he simply needs to push on either end 2, causing the braid of the tube 4 to expand releasing its bind on the boom 1, and moving the entire harness line unit any distance in the desired direction. Manufacturers of hollow braided fines refer to such a motion as "pooching up."

Figure 3:
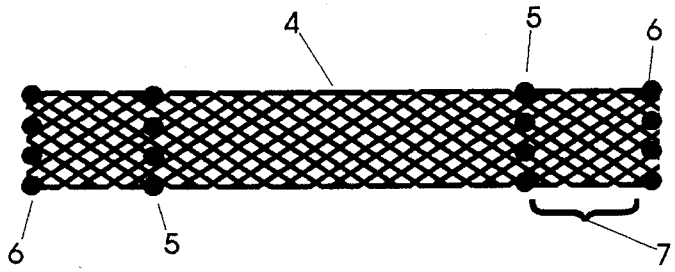
FIG. 3 is a front view of the invention in its simplest form, capable of being adapted to current and standard harness lines.

FIG. 3 shows the embodiment 4 as a separate part with added raised portions 5 and 6. The embodiment as such is adaptable to all currently manufactured windsurfing harness fines by simply cinching the harness ends 2 of FIGS. 1 and 2, loosely between the raised portions 5 and 6 which are also designated as recess 7.

The operation and use of the invention hereinabove described will be evident to those skilled in the art to which it relates from a consideration of the foregoing. It will thus be seen that there is provided a device in which the objects of this invention are achieved, and which is well adapted to meet the conditions of practical use. Its advantages are easily seen.

It is thought that persons skilled in the art to which this invention relates will be able to obtain a clear understanding of the invention after considering the foregoing description in connection with the accompanying drawings. Therefore a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. A device comprising a hollow braided tube capable of diameter expansion by manual compression beginning at either end of said tube, having depressions or raised portions at said ends in order to receive and retain cinching straps or rings of standard windsurfing harness lines.

2. The invention as recited in claim 1, wherein said tube is connected to cinched ends or rings which are connected by a loop that extends from said cinched ends or rings and hangs below the boom, thus comprising a complete windsurfing harness line unit.

* * * * *